United States Patent [19]

Kikuyama et al.

[11] 4,028,927

[45] June 14, 1977

[54] HIGH PRECISION TIMEPIECE PACE MEASURING DEVICE

[75] Inventors: Akira Kikuyama; Kazutoshi Ichinose, both of Ena, Japan

[73] Assignee: Ricoh Watch Co., Ltd., Tokyo, Japan

[22] Filed: May 10, 1976

[21] Appl. No.: 684,535

Related U.S. Application Data

[63] Continuation of Ser. No. 603,302, Aug. 11, 1975, abandoned.

[52] U.S. Cl. ..... 73/6

[51] Int. Cl.[2] ..... G04D 7/12

[58] Field of Search ..... 73/6

[56] References Cited

UNITED STATES PATENTS

| | | | |
|---|---|---|---|
| 3,238,764 | 3/1966 | Greiner | 73/6 |
| 3,370,456 | 2/1968 | Jucker | 73/6 |
| 3,777,547 | 12/1973 | Izumi | 73/6 |
| 3,805,585 | 4/1974 | Palinkas | 73/6 |
| 3,946,592 | 3/1976 | Ichikawa | 73/6 |

*Primary Examiner*—S. Clement Swisher
*Attorney, Agent, or Firm*—Spensley, Horn and Lubitz

[57] ABSTRACT

A high precision timepiece pace measuring device wherein a first mask circuit inhibits the entry of a first signal of the timepiece so as to initiate a measurement of the pace of the timepiece from a second signal of the timepiece, while a second mask circuit inhibits the entry of timepiece signals, external noises and the like during a period from a time at the initiation of the measurement to a time immediately before the termination thereof, wherein a counter circuit which receives the timepiece signals as its inputs is connected to a nine's complement presetting circuit, to a carry detecting circuit and to normal and nine's complement circuits which are respectively selected in accordance with the presence and absence of a carry in the counter circuit, and wherein output pulses of the counter circuit are fed back via a counter matrix circuit so as to set the mask period of the second mask circuit.

2 Claims, 3 Drawing Figures

HIGH PRECISION TIMEPIECE PACE MEASURING DEVICE

CROSS REFERENCE TO RELATED APPLICATIONS

This is a continuation of application Ser. No. 603,302 filed Aug. 11, 1976 now abandoned.

BACKGROUND OF THE INVENTION

1. Field of the Invention

This invention relates to a device which measures the pace of a timepiece, i.e., the slowness or fastness of a timepiece during 24 hours. More particularly, it relates to a pace measuring instrument which has an extremely small error of measurement and by which the pace is read at a glance.

2. Description of the Prior Art

The pace measurement for a timepiece is executed by detecting the ticks of the timepiece during a predetermined period of time, e.g., 2 seconds or 10 seconds and counting them by means of a counter circuit in terms of an error during 24 hours. As illustrated in a timing chart of FIG. 1, however, when the pace measurement is not started at the initiation of the first tick $S_1$ of the timepiece but the timepiece is set midway in the course of the tick $S_1$, the incomplete tick is also counted as a complete one. In consequence, an error corresponding to $\Delta t$ arises. Further, when a noise or impact occurs in the vicinity of the timepiece within the period of measurement, it is prone to be counted. Such noise or impact brings about a measurement error.

Summary of the Invention

An object of this invention is to solve the problems as stated above by inhibiting the entry of the first signal of the timepiece and starting the measurement from the second signal, and by inhibiting the entry of the clock signals, the external noises, etc. from a time at the initiation of the measurement to a time immediately before the termination thereof.

Another object of this invention is to decrease the error in the measurement by making it possible to precisely set the inhibit time interval in the period of measurement.

Still another object of this invention is to realize the digital indication so that the pace of the timepiece may be seen at a glance.

DETAILED DESCRIPTION OF THE PREFERRED EMBODIMENT

Figure 1:
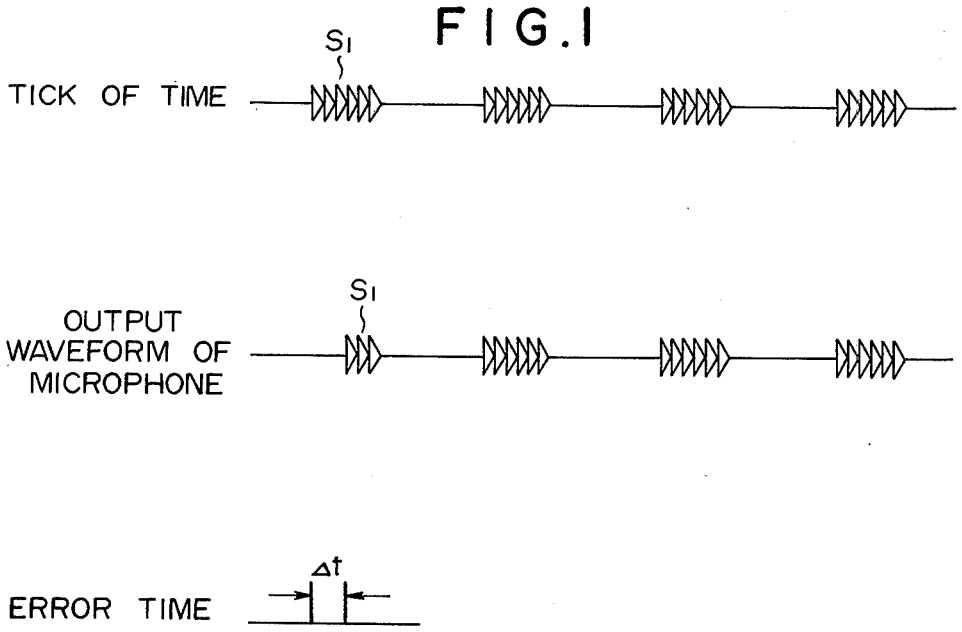
FIG. 1 is a timing chart explaining the error that occurs in a prior art instrument for measuring the pace of a timepiece precisely.
Figure 2:
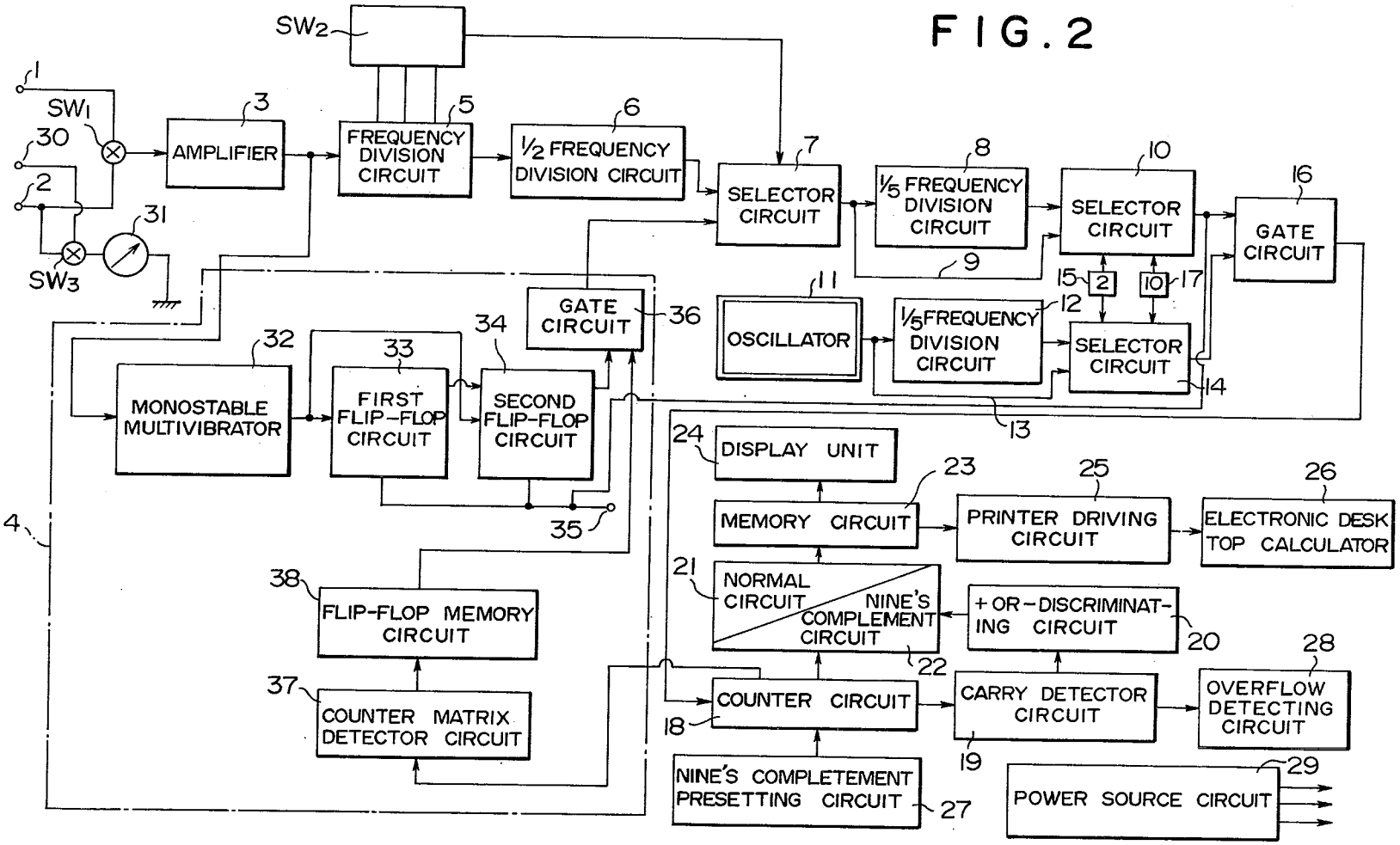
FIG. 2 is a block diagram of an instrument for measuring the pace of a timepiece in accordance with the teachings of the present invention.

FIG. 2 shows in block diagram form a high precision measurement instrument for measuring the pace of a timepiece according to this invention.

In order to detect the ticks of a timepiece, an electromagnetic-crystal microphone is mounted on an input terminal 1, while a current microphone is mounted on an input terminal 2.

The electromagnetic microphone is used in case of a quarte timepiece or a tuning fork timepiece, and the crystal microphone in case of a mechanical timepiece. Depending upon the kind of timepiece to be measured, the electromagnetic-crystal microphone is connected either to the electromagnetic microphone side or to the crystal microphone side by means of a switch. In case of an electronic timepiece, it is also possible to use the current microphone which is connected on the side of the terminal 2. Shown at $SW_1$ is a switch for selecting either the electromagnetic-crystal microphone side terminal 1 or the current microphone side terminal 2. An input signal detected by the microphone is amplified by an amplifier 3 and then entered into frequency divider circuitry as well as mask circuitry 4. The frequency divider circuitry consists of a variable frequency division circuit 5 and a ½ frequency division circuit 6, and it is arranged in parallel with the double make circuitry 4. The double mask circuitry 4 comprises a first mask circuit and a second mask circuit. The first mask circuit inhibits the first signal of the timepiece so as to initiate a measurement of the pace of the timepiece from a second signal of the timepiece. The second mask circuit inhibits timepiece signals and external noises from entering during a period from the initiation of the measurement to immediately before termination of the measurement.

$SW_2$ denotes a presetting switch. When the frequency is set at 10 – 999 Hz by the use of the presetting switch $SW_2$, a selector circuit 7 selects the output of the ½ frequency division circuit 6, whereas when the frequency is set at 1 – 9 Hz by the use of the same switch $SW_2$, the selector circuit 7 adds the output further to the output of the ½ frequency division circuit 6. That is, the 1 – 9 Hz side is selected and used in the case where the number of ticks within one second is small as in the quartz timepiece, the mechanical timepiece, etc. Whereas the 10 – 999 Hz side is utilized in the case where the number of ticks within one second is large, as in the electronic timepiece, etc., the selector circuit 7 is connected to another selector circuit 10 via a 1/5 frequency division circuit 8 as well as a bypass 9. Also, a reference oscillator 11 is connected to a selector circuit 14 via a 1/5 frequency division circuit 12 as well as a bypass 13. Buttons 15 and 17 are for the selections of 2 seconds — and 10 seconds — measurements, respectively. Upon depression of the button for the 2 seconds-measurement 15, the selector circuit 10 causes the signal from the ½ frequency division circuit 6 to enter a gate circuit via the bypass 9, and simultaneously, the selector circuit 14 causes a pulse of the reference oscillator 11 to enter the gate circuit 16 via the bypass 13. The gate circuit 16 takes the AND (logical product) between both the signals. Thus, the measurement is performed for 2 seconds. Upon depression of the button for the ten seconds-measurement 17, the selector circuit 10 causes a signal from the 1/5 frequency division circuit 8 to enter the gate circuit 16, and simultaneously, the selector circuit 14 causes a pulse, produced from the reference oscillator 11 and subjected to the frequency division by the 1/5 frequency division circuit 12, to enter the gate circuit 16. The gate circuit 16 takes the AND between both the signals. Thus, the measurement is performed for ten seconds. The reason why the period of measurement and the working frequency are changed by the frequency divider circuits and the selector circuits in this manner is making it possible to select the measuring conditions according to the kind of the timepieces because the timepiece with a low precision, such as mechanical timepiece, may well be measured for only b 2 seconds whereas the timepiece with a high precision, such as quartz timepiece, need be measured for about 10 seconds so as to acquire a mean value of measurement. The output of the gate circuit 16 is computed via a counter circuit 18, and the resultant numerical value is digitally indicated by a display device. Display device 24 may be any numeric LED display known in the art. At this time, a carry detector circuit 19 detects the presence or absence of a carry, a + or − discriminator circuit 20 discriminates + or − (fastness or slowness) to indicate it by means of, for example, a lamp, and a signal enters either a normal circuit 21 or a nine's complement circuit 22, depending upon the presence or absence of the carry. In the presence of the carry, the + or − discriminating circuit 20 indicates − in the case of the timepiece, and the normal circuit 21 receives the signal. Subsequently, a memory circuit 23 stores the numerical value, and the display unit 24 indicates the numeral. When it is desired to print out the numeral, an electronic desk top calculator 26 separately provided can be actuated through a printer driving circuit 25. In the absence of the carry, the + or − discriminating circuit 20 indicates + in case of the timepiece, and the nine's complement circuit 22 receives the signal. It is converted into the nine's complement, which is stored into the memory circuit 23 as the subtracted answer and which is displayed or printed out as in the foregoing. The counter circuit 18 will now be explained by taking concrete examples as to the 2 seconds-measurement. When the timepiece has no error, the number of pulses that pass through the gate circuit 16 during 2 seconds is set to 8,640,000, which is 100 times as many as the number of seconds in a day. A nine's complement presetting circuit 27 is therefore set at 1,359,999. Assuming here that the timepiece is slow by 2 pulses, the gate circuit 16 delivers a signal of (8,640,002 pulses) (2 seconds). In the counter circuit 18, consequently, 8,640,002 + 1,359,999 = 10,000,001, and a carry arises. The result has 1 added thereto, and is indicated as 0000002. At this time, due to the presence of the carry, the + or − discriminating circuit 20 falls into − in case of the timepiece, so that the indication is made as the slowness of 2 pulses. If, conversely, the timepiece is fast by 2 pulses, the gate circuit 16 delivers a signal of (8,639,998 pulses)/(2 seconds). In the counter circuit 18, consequently, 8,639,998 + 1,359,999 = 9,999,997, and no carry arises. Therefore, the + or − discriminating circuit 20 falls into + in case of the timepiece. The nine's complement circuit 22 is selected by a signal from the + or − discriminating circuit 20, and provides the nine's complement. More specifically, the above-mentioned value 9,999,997 is subtracted fro 9,999,997, resulting in 0000002, so that the indication is made as the fastness of 2 pulses. Since one day is 86,400 seconds, one pulse in this case corresponds to a daily rate of 1/100 seconds. The fastness or slowness of the timepiece indicated by a difference of 2 pulses results in an error of 0.02 second in a daily rate. Reference numeral 28 designates an overflow detecting circuit. When the fastness or slowness is too large to indicate it by the display unit 24, the overflow detecting circuit 28 detects such state and indicates it by means of, for examples, a lamp. Shown at 29 is a power source circuit.

This invention is applicable not only to the pace measurement for the timepiece but also to the battery check for the timepiece. A terminal 30 is connected through a changeover switch $SW_3$ to a voltammeter 31. By setting the timepiece on the terminal 30 and throwing the change-over switch $SW_3$ onto the meter side, the voltage and current of a battery of the timepiece are indicated by the voltammeter 31.

Figure 3:
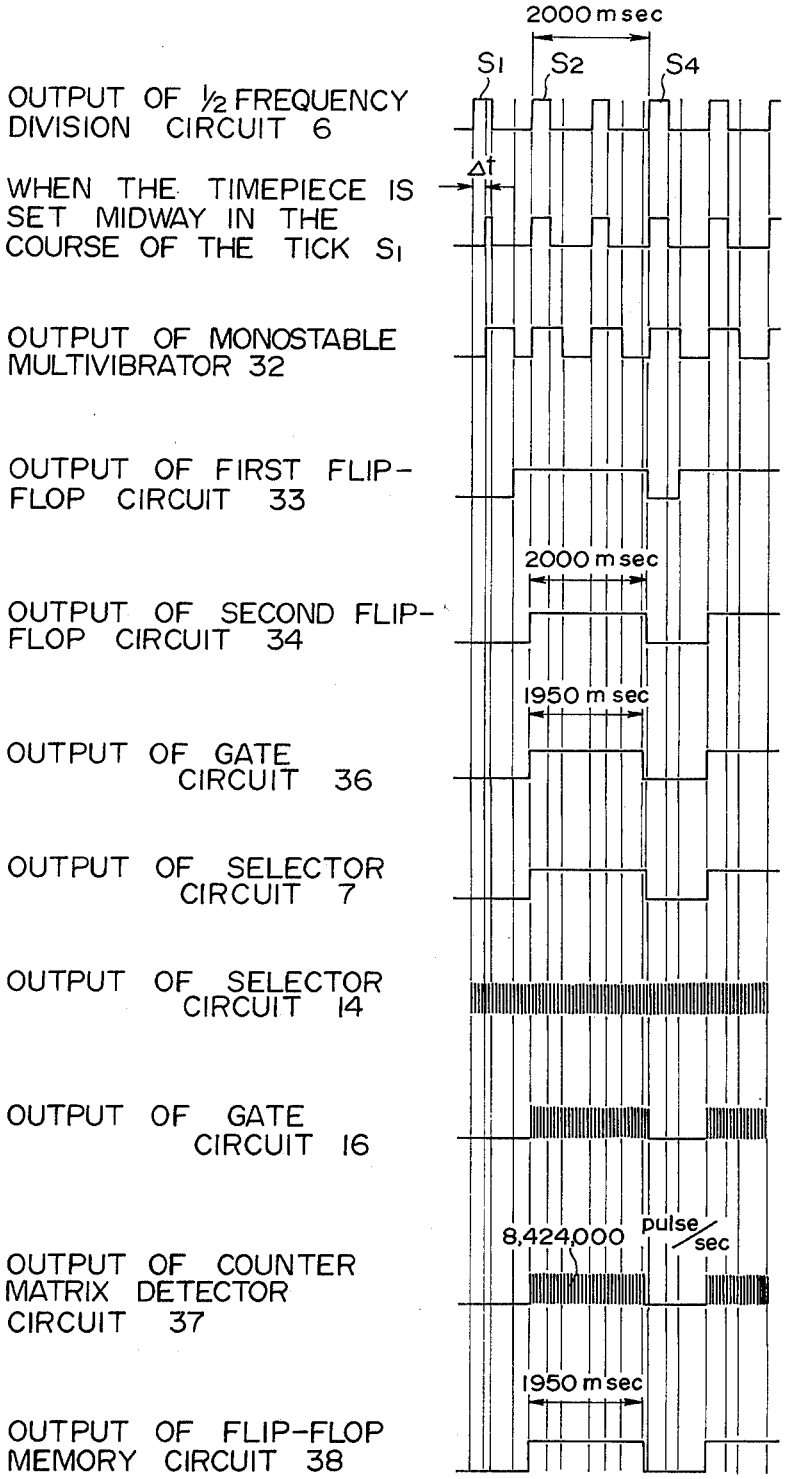
FIG. 3 is a timing chart in case of the pace of a timepiece was measured during 2 seconds by the instrument of FIG. 1.

Description will now be made of the double mask circuitry 4 which forms the essential portion of this invention. A monostable multivibrator 32, a first flip-flop circuit 33 and a second flip-flop circuit 34 are connected on the output side of the amplifier 3 in the order mentioned. The output of the second flip-flop circuit 34 is entered into the selector circuit 7 via the gate circuit 36. For this reason, as illustrated in FIG. 3, the signals of the timepiece are amplified by amplifier 3, Subsequently, they are shaped by the monostable multivibrator 32. The output of the monostable multivibrator 32 is inputted to first flip-flop circuit 33. The output of the first flip-flop circuit 33 turns on at the termination of the first signal $S_1$ of the timepiece. That is, the first flip-flop circuit 33 inhibits the first signal $S_1$ of the timepiece. The output of the first flip-flop circuit 33 is inputted to the second flip-flop circuit 34. The output of the second flip-flop circuit 34 turns on at the initiation of the second signal $S_2$ of the timepiece. As the output of the second flip-flop circuit 34 turns on, gate circuit 36, selector 7 and gate circuit 16, etc. turns on, to start the measurement. Numeral 35 denotes a terminal for a reset signal. Interposed between the second flip-flop circuit 34 and the selector circuit 7 is the gate circuit 36, which is adapted to open after lapse of second mask period. In this case, the second mask period is accurately set by a counter matrix detector circuit 37. More specifically, the output signal of the counter circuit 18 stated above is inputted to the matrix detector circuit 37 which is composed of diodes or an IC. The signal is stored into a flip-flop memory circuit 38 which succeeds to the detector circuit 37. Thus, when a preset number of pulses arrive, the gate circuit 36 is turned off to release the masking. In cases where the measurement period is 2 seconds or 2000 milliseconds and the second mask period is 1950 milliseconds, the counter matrix detector circuit 37 turns off when the output signals of the counter circuit 18 was counted up to 8,640,000 × 1950/2000 =8,424,000 pulses. So, the flip-flop memory circuit 38 turns off after the lapse of 1950 milliseconds counting from the initiation of the measurement, and at the same time the gate circuit 36 turns off as well. Consequently, timepiece signals and external noises are inhibited from entering during a period from the initiation of the measurement until the lapse of 1950 milliseconds. In particular, the second mask period is determined by counting the pulses by means of the counter matrix detector circuit 37. This expedient eliminates the problem of fluctuation of the mask period due to the change of the ambient temperature, etc., the problem existing in a system which determines the mask period by a charging-and-discharging time based on a capacitor and a resistor contained in a monostable multivibrator. The noise mixing rate can accordingly be reduced by making the mask period sufficiently long. The gate circuit 36 turns off. Then, as the masking was released, the fourth signal of the timepiece is inputted from the ½frequency division circuit 6 to the selector circuit 7. And simultaneously with the input, the output of the selector circuit 7 turns off. Thus, the gate circuit 16 turns off also. The counter circuit 18 counts the number of the pulses which go through the gate circuit 16 from the initiation of the measurement, and the instrument according to this invention decides the fastness or slowness of the timepiece by the abovementioned means. On the other hand, the output of the selector circuit 7 is inputted to the gate circuit 16 through the selector circuit 10, at the same time the output of the selector circuit 7 is also inputted to a reset circuit of the first flip-flop circuit 33 and the second clip-flop circuit 34, so as to reset them.

We claim:

1. A high precision timepiece pace measuring device, comprising:

a first mask circuit for inhibiting a first signal of said timepiece so as to initiate a measurement of said pace of said timepiece from a second signal of said timepiece;

a second mask circuit for inhibiting timepiece signals and external noises from entering during a predetermined period from a time at the initiation of the measurement to a time immediately before termination thereof;

a counter circuit which receives said timepiece signals as its inputs;

a nine's complement presetting circuit, a carry detecting circuit, and normal and nine's complement circuits, said presetting circuit, detecting circuit and normal and nine's complement circuits each being connected to said counter circuit, said normal and nine's complement circuits being respectively selected in accordance with presence and absence of a carry in said counter circuit; and a counter matrix circuit for feeding back output pulses of said counter circuit so as to set said mask period of said second mask circuit.

2. A high precision timepiece according to claim 4 wherein said timepiece includes a first terminal with a first microphone coupled thereto and a second terminal with a second microphone coupled thereto.

* * * * *